US005772422A

United States Patent [19]

Ferguson

[11] Patent Number: 5,772,422

[45] Date of Patent: Jun. 30, 1998

[54] BURNER ARRAY FOR WATER HEATING APPARATUS

[75] Inventor: Mark A. Ferguson, Watauga, Tex.

[73] Assignee: PVI Industries, Inc., Fort Worth, Tex.

[21] Appl. No.: 703,847

[22] Filed: Aug. 27, 1996

[51] Int. Cl.[6] ..... F24H 1/20; F22B 5/00

[52] U.S. Cl. ..... 431/185; 431/9; 431/181; 431/116; 126/360 R; 239/399

[58] Field of Search ..... 431/8, 116, 159, 431/181, 182, 183, 184, 185, 187, 189, 9; 126/360 R; 239/399, 401, 416.4, 416.5

[56] References Cited

U.S. PATENT DOCUMENTS

| | | | |
|---|---|---|---|
| 2,177,245 | 10/1939 | Dennis | 239/399 |
| 2,464,791 | 3/1949 | Bonvillian et al. | 431/184 |
| 3,682,390 | 8/1972 | Cheshire et al. | 60/748 |
| 3,948,593 | 4/1976 | Moore et al. | 431/8 |
| 4,465,024 | 8/1984 | Adams | 126/361 |
| 4,545,329 | 10/1985 | Adams | 126/361 |
| 4,932,861 | 6/1990 | Keller et al. | 431/8 |
| 4,938,204 | 7/1990 | Adams | 126/360 R |
| 5,207,212 | 5/1993 | Woollen, Jr. | 126/391 |
| 5,251,447 | 10/1993 | Joshi et al. | 60/748 |
| 5,400,962 | 3/1995 | Adams et al. | 431/12 |

*Primary Examiner*—Carl D. Price
*Attorney, Agent, or Firm*—Charles D. Gunter, Jr.

[57] ABSTRACT

The invention relates to a water heating apparatus which uses a submergible, pressurized combustion chamber having multiple external heating surfaces, a forced draft burner and a flue collector that collects and passively recirculates a portion of the flue gases back into the burner air intake region. An improved burner array more completely mixes the combustible gases in the combustion region and operates over a wide range of input demands.

20 Claims, 3 Drawing Sheets

BURNER ARRAY FOR WATER HEATING APPARATUS

BACKGROUND OF THE INVENTION

1. Field of the Invention

The present invention relates generally to water heating devices, such as water heaters and boilers, and to an improved burner array for such devices which can be used with a passive flue gas recirculation system for improved burner efficiency while reducing undesirable emissions during heating.

2. Description of the Prior Art

For many years, typical water heater construction provided for the flow of hot gas through a series of tubes mounted in vertical fashion between top and bottom support plates within the water heater tank. Water was circulated into and out of a chamber in the prior art devices located between the support plates. The water contacted and circulated about the exterior of the vertical tubes to effect heat transfer to heat the water.

The typical prior art gas, oil and gas/oil fired water heating devices (referred to herein as "water heaters") thus featured a non-pressurized, external combustion chamber. The location of the combustion chamber on the exterior of the water heater resulted in lost heat and lower thermal efficiency. Also, the tubes and support plates were not easily accessible, which generally required disassembly of the entire tank for maintenance and replacement.

In U.S. Pat. Nos. 4,465,024; 4,545,329 and 4,938,204, all assigned to the assignee of the present invention, water heater designs are shown which feature one or more submergible, pressurized combustion chambers so that all combustion takes place in the water heater tank interior in a chamber surrounded by water. The improved water heater designs featured an externally mounted, forced draft burner unit mounted on the exterior of the closed tank at a tank opening so that the burner nozzle extended in the direction of the combustion chamber for heating the combustion chamber. The resulting designs decrease heat loss and increase the thermal efficiency of the water heaters many times over that which was achievable with the prior art tube and plate arrangement.

Despite the above noted improvements in water heater and boiler design, a need has continued to exist for an improved burner design for supplying a mixture of combustible gases to the combustion chamber of such devices. Specifically, improved burner arrays are needed which provide efficient mixing of the entering burner air and gas streams and introduction of such gas mixtures into the combustion chamber for efficient combustion. In the usual case, a low pressure natural gas stream is being introduced into a forced draft air supply fed by a power blower at a higher pressure. The function of the burner array is to introduce the flow of relatively lower pressure natural gas into the relatively higher pressure forced air stream, the gas mixture being passed through some sort of restriction or orifice. Also, water heaters and boilers form nitrogen oxides during combustion. Nitrogen oxide emissions are air pollutants. Various state and federal agencies regulate the amount of nitrogen oxides, or $NO_x$, in vented gases, especially in heavily populated areas. Tightening state and federal regulations for emissions requirements warrant the effort to find new ways to remove or prevent the formation of nitrogen oxides in combustion processes to avoid further harmful effects on the environment.

Flue gas recirculation reduces $NO_x$ emissions from water heating systems by decreasing the amount of $NO_x$ formed.

Typically, a duct connects a flue stack to a recirculation fan. Another duct couples the fan to the combustion air inlet of a burner or the combustion chamber. Since these systems directly feed the recirculated flue gas to the burner flame region where fuel is also being introduced, they often require the use of relatively complex control devices to regulate the feed of recirculated flue gas for efficient and safe combustion and therefore tend to be overly complex in design.

To the best of Applicant's knowledge, prior attempts to use passive flue gas recirculation have not been successful in systems of the type presently under consideration. These passive systems either do not work for a submergible, pressurized combustion device with a high turbulence power blower, often due to poor combustion, or the level of $NO_x$ emissions is too high for the present government regulations. For example, many power burners with air suction and high pressure delivery characteristics cannot use a passive recirculation system. These systems require a separate blower strictly for the purpose of inducing combustion products from the burner vent and forcing them into a combustion chamber were fuel is also being introduced. In the process, combustion air and recirculated flue gas incompletely mixes before introducing the fuel, thus leading to incomplete combustion.

An object of the present invention is to provide an improved water heating apparatus having a novel burner distribution array for creating more efficient combustion within a submerged combustion chamber of the device.

Another object of the invention is to provide a passive flue gas recirculation system for such a water heating apparatus having a submerged combustion chamber which reduces $NO_x$ levels and yet does not interfere with the efficiency of combustion.

Another object of the present invention is to produce such a water heating device having a passive flue gas recirculation system which premixes flue gases and fresh air in a gas-mixing region of the burner intake prior to the introduction of fuel and the beginning of the combustion process.

SUMMARY OF THE INVENTION

A burner array is shown for supplying a combustible mixture of gases to the combustion region of a burner used to fire a water heating apparatus. The burner array includes a collar member having a hollow interior which communicates with a source of combustible gas. The collar member has a peripheral interior surface with a plurality of mounting openings. A ring-like arrangement of wing-shaped elements is mounted on the peripheral interior surface of the collar member.

Each wing-shaped element includes a cylindrical tube member with an interior and with an end opening which communicates with a respective mounting opening on the collar member for supplying combustible gas to the interior of the tube member. Each cylindrical tube member also has a tube slit along one side thereof and an outwardly extending flange portion. Each of the tube slits has a fixed opening area through which combustible gas can pass. The opening area can be varied by varying the position of the flange portions of adjacent wing-shaped elements within the collar member.

Preferably, each tube member is mounted on the peripheral interior surface of the collar by an adjustable fitting at a first angular position. The angular position of the outwardly extending flange portions of the wing-shaped elements is adjustable by turning the tube members in the adjustable fittings. The angular position of the outwardly extending flange portions of the wing-shaped elements can be adjusted between a closed or restricted position in which the outwardly extending flange portions form a generally closed plane within the collar member and obstruct the tube slit openings and an infinite number of angularly open positions which create flow paths across the position of the closed plane.

The improved water heating apparatus of the invention includes a closed tank having an exterior, an interior and external walls having at least one opening therein. A submerged combustion chamber is mounted within the tank opening and has an end opening. A flue collector is mounted on the tank, the flue collector having a flue opening which communicates with the combustion chamber and having an annular chamber surrounding the flue opening and separated therefrom which receives the products of combustion produced within the combustion chamber.

A burner array is mounted at the combustion chamber end opening for supplying a combustible mixture of gases to the combustion chamber for firing the water heating apparatus. The burner array includes (a) a collar member having a hollow interior which communicates with a source of combustible gas, the collar member having a peripheral interior surface with a plurality of mounting openings; (b) a ring-like arrangement of wing-shaped elements mounted on the peripheral interior surface of the collar member, each element having a cylindrical tube member with an interior and with an end opening which communicates with a respective mounting opening on the collar member for supplying combustible gas to the interior of the tube member, each cylindrical tube member also having a tube slit along one side thereof and an outwardly extending flange portion; and (c) each of the tube slits having a fixed opening area through which combustible gas can pass, the opening area being buried by varying the position of the flange portions of the wing-shaped elements within the collar member.

An air-fed blower has an outlet which communicates with the combustion chamber for producing controlled combustion within the combustion chamber. The air-fed blower also has an air intake region. Preferably, the flue collector which is mounted to the combustion chamber on the tank exterior has a flue gas recirculation outlet leading from the annular chamber thereof. A flue gas recirculation conduit passively connects the flue gas recirculation outlet of the flue gas collector with the air intake region of the blower. Preferably, the flue gas from the flue collector is divided between a primary flue gas recirculation conduit and a secondary, low fire flue gas recirculation conduit, both of which are connected with the air intake region of the blower.

Additional objects, features and advantages will be apparent in the written description which follows.

DETAILED DESCRIPTION OF THE INVENTION

Figure 1:
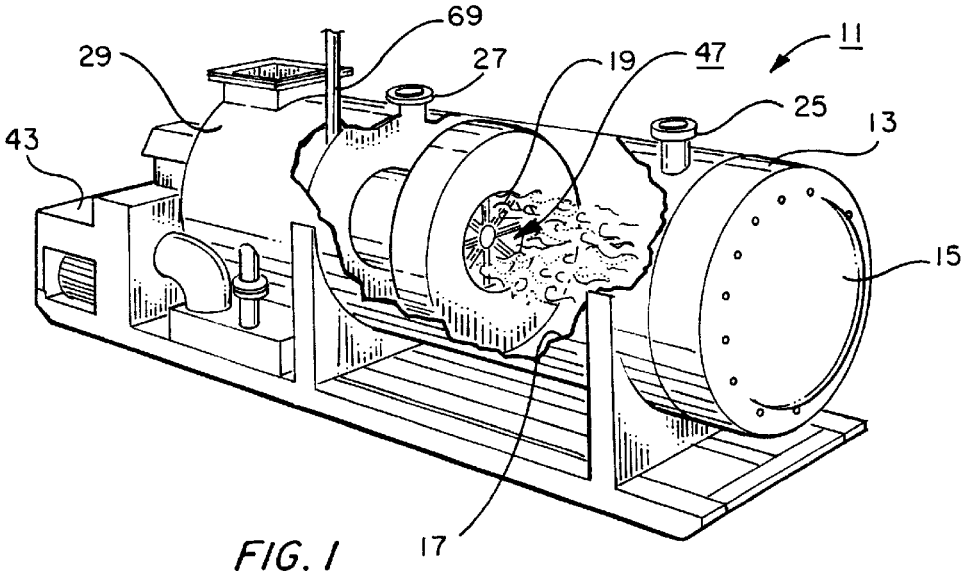
FIG. 1 is a perspective view of an improved water heating apparatus of the invention with the tank being shown partly broken away to illustrate the improved burner array and combustion chamber thereof.

FIG. 1 shows a water heating apparatus of the invention designated generally as 11. The water heating apparatus, referred to herein as either a "water heater" or "boiler" includes a closed tank 13 having an exterior 15, an interior 17 (FIGS. 1 and 3) and external side walls having at least one opening 19 therein. As shown schematically in FIG. 3, a submerged combustion chamber 21 is mounted within the tank opening 19 and has an end opening 23. Water is supplied to the tank closed interior 17 by means of a water inlet 25 and passes out a water outlet 27 after being heated within the tank closed interior by heat exchanged with the submerged combustion chamber.

A flue collector 29 is mounted on the tank. The flue collector has a flue opening 31 (FIG. 3) which communicates with the combustion chamber 21 and has an annular chamber 33 which surrounds the flue opening 31 and which is separated therefrom which receives the products of combustion produced within the combustion chamber 21. The products of combustion are conveyed to the flue collector by means of a plurality of curved tubes 35, 37 (two shown in FIG. 3). The curved fire tubes 35, 37 comprise a plurality of external heating surfaces for the submerged combustion chamber 21.

Figure 3:
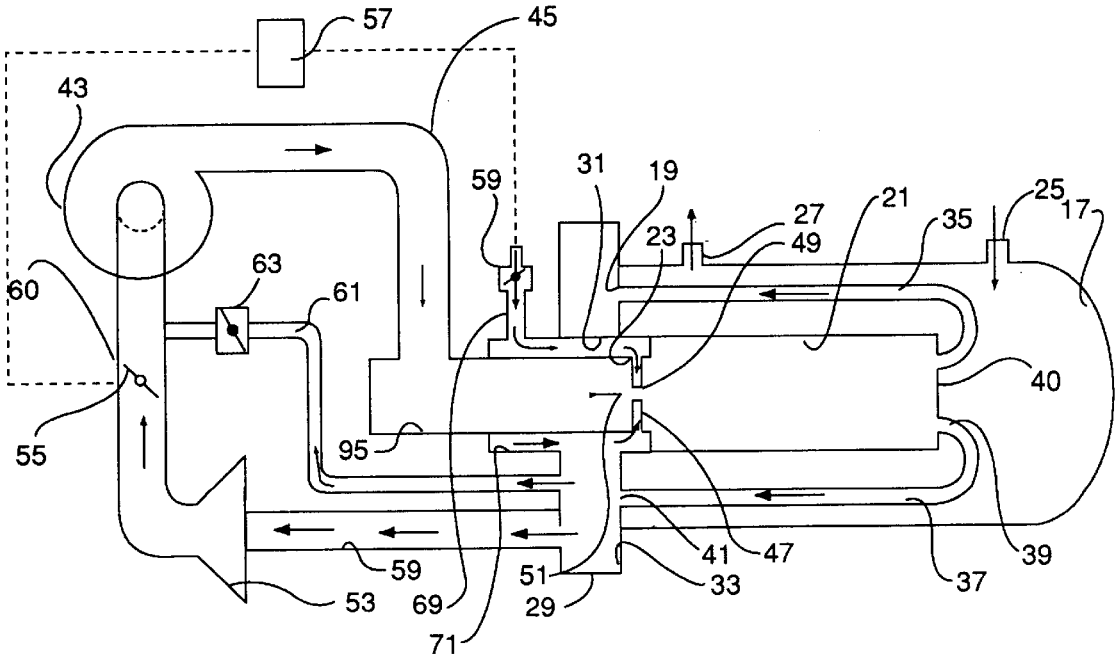
FIG. 3 is a simplified, schematic view of the operation of the improved water heating apparatus of FIG. 1.
Figure 4:
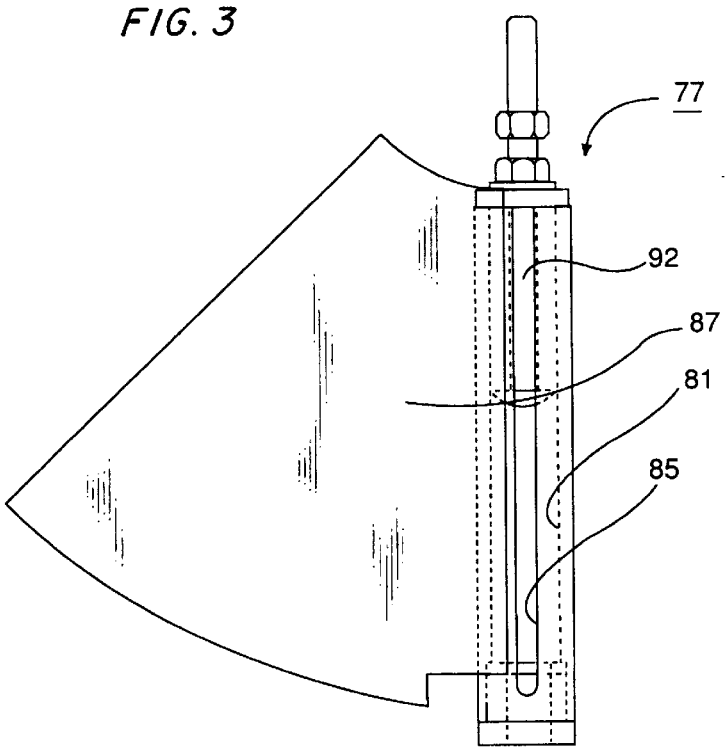
FIG. 4 is an isolated, side view of a single wing-shaped element used in the burner array of the water heating apparatus of FIG. 1.

As shown in FIG. 3, at least part of the combustion chamber 21 and all of the heating surfaces are submerged in the tank water under pressure during operation. Each curved tube 37 has an end 39 which communicates with the combustion chamber through its closed end 40 and has an opposite end 41 which communicates with the annular chamber 33 of the flue collector 29. The combustion chamber 21 extends at least partially the length of the curved fire tubes 35, 37, thus creating a long leg running along the exterior of the combustion chamber and separated by the U-shaped portions from a short leg that joins and extends through the closed end of the combustion chamber. The length of the combustion chamber 21 can vary, depending upon the application. Although a small number of curved tubes 35, 37 are shown in FIG. 3 for simplicity, a greater number of tubes are typically used in practice. Further details of the construction and mounting of the combustion chamber assembly are shown in U.S. Pat. No. 4,545,329, issued Oct. 8, 1985, to PVI Industries, Inc., the disclosure of which is incorporated herein by reference.

As shown in FIG. 3, combustion air is supplied to the water heating apparatus of the invention by means of an impeller blower 43. Combustion air passes from the impeller 43 through a conduit 45 to a burner array 47 of the invention. The blower 43 has an air intake shroud 53 for the intake of combustion air, the supply of air to the blower being controlled by a modulating air control damper 55. The modulation control 57 is commercially available and described, for example, in such references as U.S. Pat. No. 5,400,962, issued Mar. 28, 1995, and assigned to the assignee of the present invention, the disclosure of which is hereby incorporated herein by reference. The modulation control also electronically controls the inlet valve for natural gas entering the apparatus through valve 59. The burner array includes a central opening 49 for communicating with the combustion chamber interior. An ignition electrode 51 is located in the vicinity of the burner array 47 for producing combustion. The combustion gases which are created within the combustion chamber 21 enter the annular chamber 33 of the flue collector 29 and pass through a primary flue gas recirculation conduit 59 to the air intake shroud of the blower 43. Preferably, the flow of flue gas is also divided between the primary conduit 59 and a secondary, low fire flue gas recirculation conduit 61 whose flow is controlled by means of damper 63.

Figure 2:
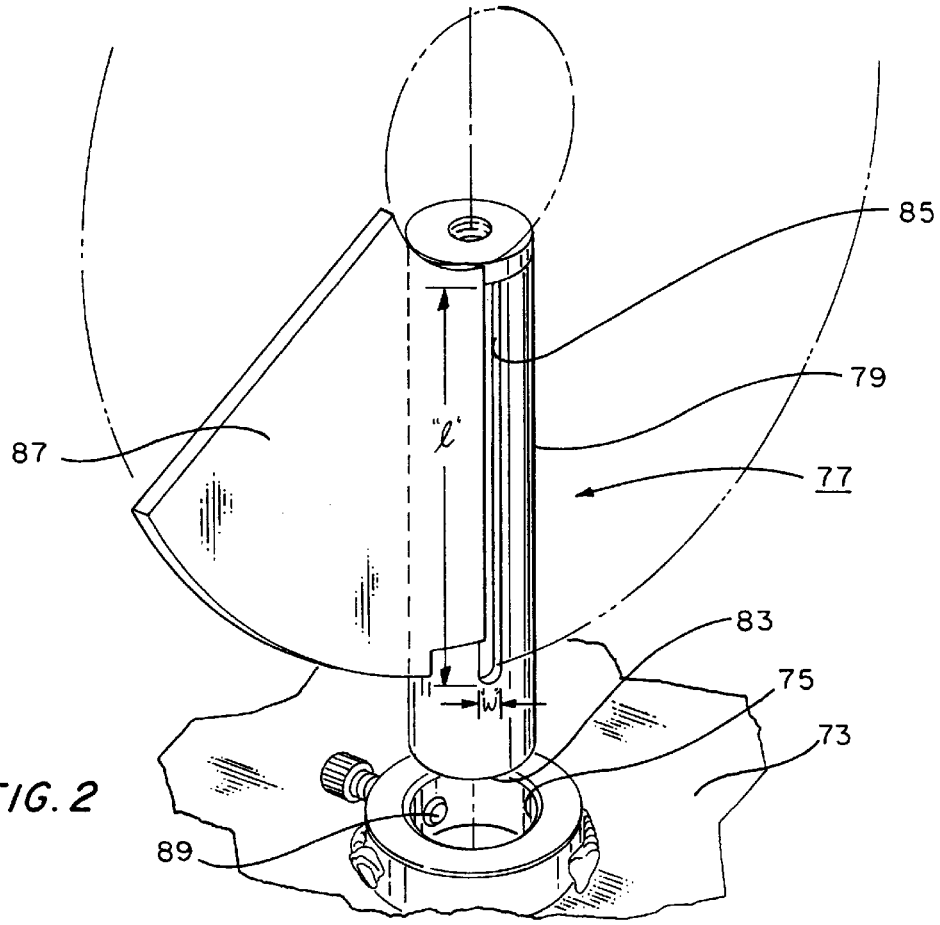
FIG. 2 is an isolated view of the wing-shaped elements used in the burner array of the water heating apparatus of FIG. 1.
Figure 7:
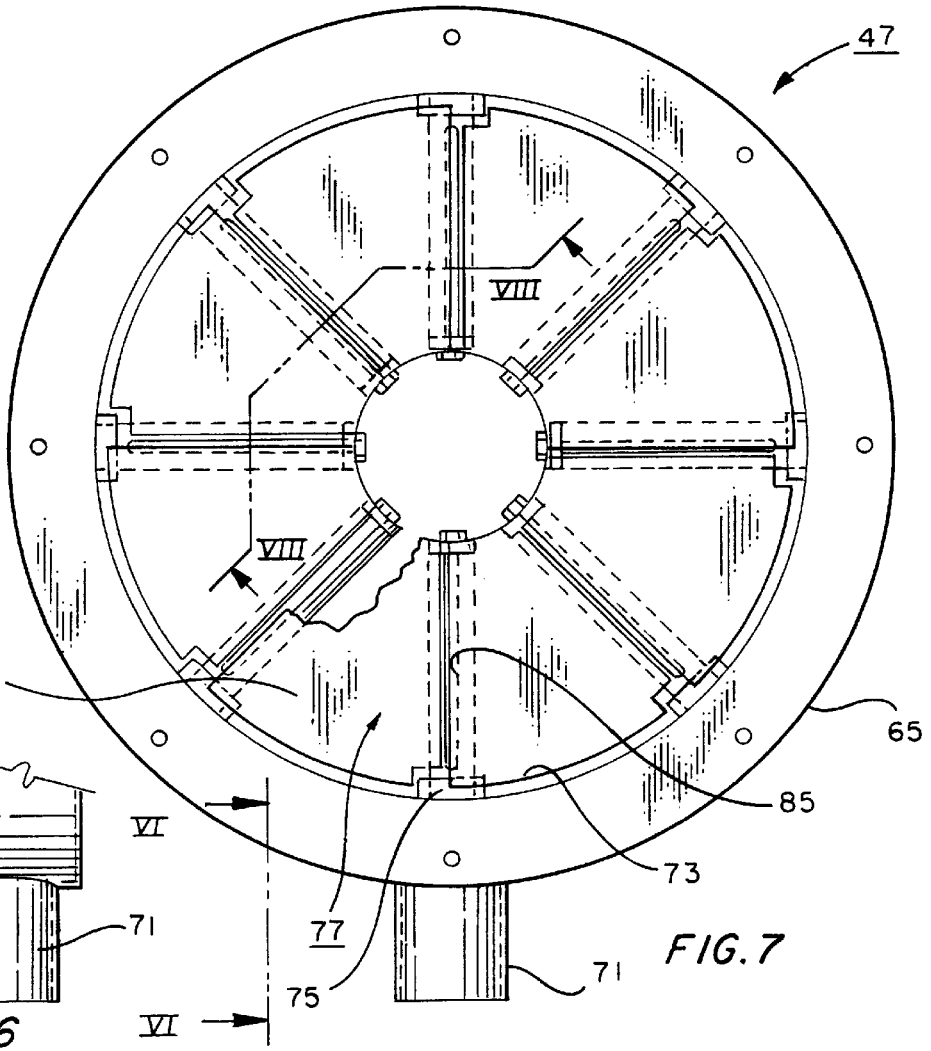
FIG. 7 is an end view of the burner array which is used with the improved water heating apparatus of the invention.
Figure 6:
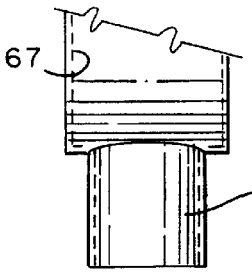
FIG. 6 is a partial, side view of the burner array of the invention taken along lines VII—VII in FIG. 7.

As shown in FIG. 7, the burner array 47 of the invention includes a collar member 65 which comprises a ring-like structure having a hollow interior 67 which communicates with the source of combustible gas supplied through the inlet conduit (69 in FIG. 3) by means of the annular area 71. The collar member 65 also has a peripheral interior surface 73 (FIG. 2). As best seen in FIG. 7, a ring-like arrangement of wing-shaped elements 77 are mounted on the peripheral interior surface 73 of the collar member 65. There are eight wing-shaped elements in the preferred embodiment shown, although more or less elements could be used, depending upon the particular application and heating demand.

Each element 77 has a cylindrical tube member 79 with an interior 81 and with an end opening 83 (FIG. 2) which communicates with a respective mounting opening 75 on the collar member 65 for supplying combustible gas to the interior of the tube member. Each cylindrical tube member 79 also has a longitudinal tube slit 85 which runs along one side thereof. In the embodiment of FIG. 2, the tube slit 85 extends along the majority of the length of the cylindrical tube member 79 and has a width "w" which is substantially less than its length "l." Each of the tube slits 85 has a fixed opening area (l×w) through which combustible gas can pass.

Figure 8:
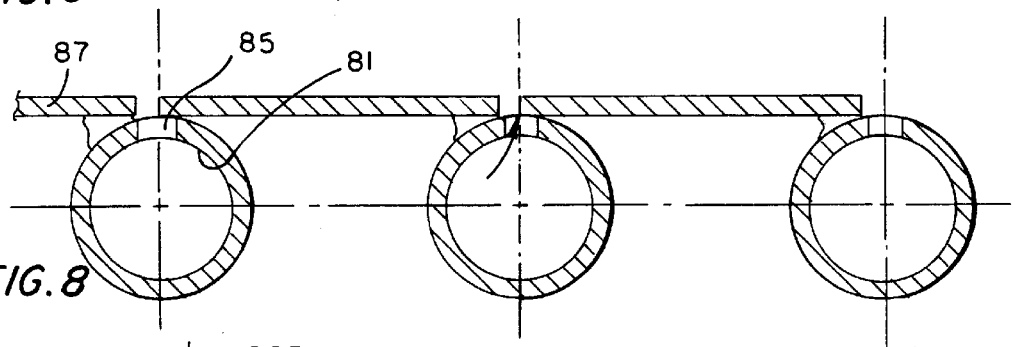
FIG. 8 is a partial, isolated view of three of the wing-shaped elements of the burner array in the fully closed angular position taken along lines VIII—VIII in FIG. 7.
Figure 9:
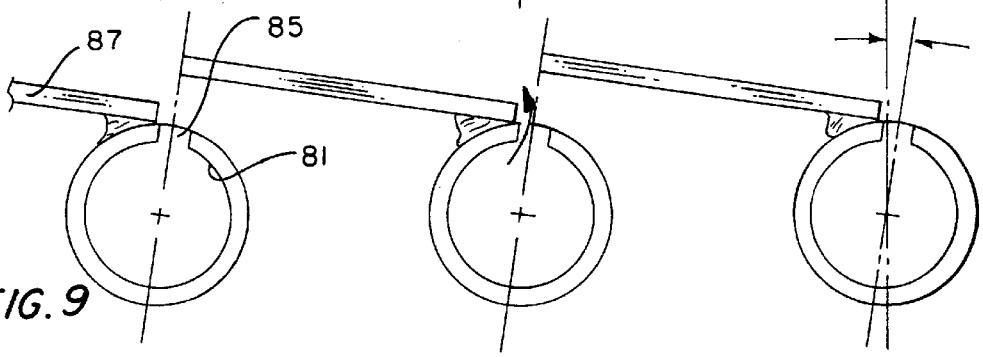
FIG. 9 is a view similar to FIG. 8 showing movement of the wing-shaped elements to an angularly open position.

Each element 77 also has an outwardly extending flange portion 87. The opening area of the tube slits can be varied by varying the position of the flange portions 87 of the wing-shaped elements within the collar member. The outwardly extending flange portions 87 form pie-shaped wedges in an aligned plane, as shown in the end view of FIG. 7. As shown in FIGS. 8 and 9, the outwardly extending flange portions 87 of each wing-shaped element extends approximately normal to the direction of flow of combustible gas exiting the tube slit 85 (shown by the arrows in FIGS. 8 and 9).

Each tube member is mounted on the peripheral interior surface of the collar 65 at a first angular position (FIG. 8). The angular position of the outwardly extending flange portions of the wing-shaped elements can be adjusted, as by turning a set screw 89, (FIG. 2) so that the tube members can be turned in their adjustable fittings. The outwardly extending flange portions 87 of the wing-shaped elements can be adjusted from the closed or near closed position shown in FIG. 8 in which the outwardly extending flange portions form a generally closed plane with the collar member 65 and obstruct the tube slit openings 85 and an infinite number of angularly open positions (FIG. 9) which create flow paths across the position of the closed plane.

Figure 5:
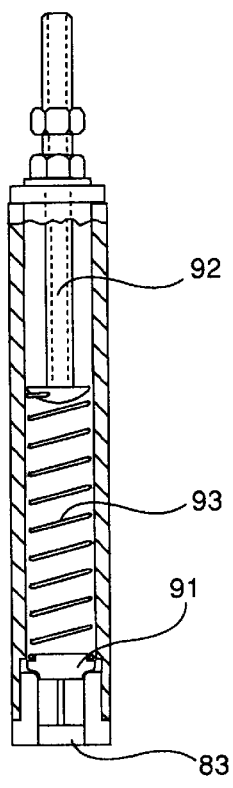
FIG. 5 is an end, cross-sectional view of the wing-shaped element of FIG. 4.

As shown in FIG. 5, each wing-shaped element can incorporate an additional control means for further controlling the flow of combustible gases through the tube interior 81 and out the tube slits 85. In the embodiment shown in FIG. 5, a spring loaded poppet 91 biased downwardly by means of spring 93 and threaded end member 92. In the position shown, the poppet 91 restricts the end opening 83. A sufficient gas pressure entering the end opening 83 will unseat the poppet 91, however, thereby admitting combustible gas to the interior 81 of the wing-shaped element.

In operation, a mixture of combustible gases is supplied to the combustion chamber interior 21 for creating products of combustion within the chamber. For example, natural gas can be supplied through the valve 59, conduit 69 and annular area 71 to the hollow ring member of the burner array 47. The combustible gas is communicated to the cylindrical tube interiors 81 and passes out tube slits 85 where it is mixed with air passing through the burner chamber 95 (FIG. 3). The electrode bundle 51, or other ignition means, ignites the gaseous mixture in the vicinity of the burner array.

The products of combustion pass from the combustion chamber interior 21 through the curved fire tubes 35, 37 to the annular chamber 33 of the flue collector 29. There the products of combustion are divided between the primary flue gas recirculation conduit 59 and the secondary, or low fire flue gas recirculation conduit 61. Thus the flue gas recirculation conduits 59, 61 passively channel a portion of the flue gas back to the air intake shroud of the blower 43. The diameter of the conduits 59, 61 are determined by the burner capacity and the desired flame temperature of the burner. In one embodiment, for example, the secondary conduit 61 was 2 inch in diameter while the primary conduit 59 was 6 inch in diameter. The damper 63 and modulating air control damper 55 provide additional control of the volume of flue gas passively recirculated to the blower.

Fresh air entering the shroud 53 along with flue gas products entering the passageway 60 from the recirculating conduits 59, 61 are combined prior to being drawn into the blower fan impeller and being impelled down the fuel/air mixing passageway 95. The firing condition of the burner would be used to signal the control valve 55 by means of modulation control 57 as well as modulating the gas control valve 59. The secondary recirculation conduit 61 allows return gases to flow when the damper/valve 55 is closed and when the fresh air supply to the passageway 60 is shut off or nearly off during modulated low fire or pilot operation of the burner.

An invention has been provided with several advantages. The burner array 47 with its wing-shaped adjustable elements 77 provides a convenient mechanism for introducing a relatively low pressure combustible gas into a high pressure air stream. The flange portions of the wing-shaped elements can be adjusted in angular position between a closed or near closed position which obstructs the flow of gas and an infinite number of angular positions which allow an increased flow of gas. The flow of gas exiting the cylindrical tube slits is at a right angle to the planar area of the flange portions thereby increasing the turbulence and mixing action of the combustible gas with the air flow entering the combustion chamber. The adjustable wing-shaped elements allow the water heater apparatus to operate over a wider range of inputs than is possible with a typical fixed head burner.

The apparatus also includes a unique passive flue gas recirculation system. The present water heating apparatus utilizes a passive flue gas recirculation system for a submerged combustion chamber/forced draft burner water heating device that reduces $NO_x$ levels, yet does not interfere with the efficiency of combustion. The passive flue gas recirculation system premixes flue gases and fresh air in a gas mixing region of the burner prior to the introduction of fuel and the beginning of the combustion process. The prior art passive systems either have not worked for a submergible, pressurized combustion device with a high turbulence power burner. The prior passive systems did not mix fresh air with the recirculated flue gas prior to combustion. These systems tended to blow recirculated flue gas directly into the burner flame where it remained separated from the combustion air.

While the invention has been shown in only one of its forms, it is not thus limited but is susceptible to various changes and modifications without departing from the spirit thereof.

What is claimed is:

1. A burner array for supplying a mixture of natural gas and air to the combustion region of a burner used to fire a water heater or boiler, the burner array comprising:

a collar member having a hollow interior which communicates with a source of natural gas, the collar member having a peripheral interior surface with a plurality of mounting openings;

a ring-like arrangement of wing-shaped elements mounted on the peripheral interior surface of the collar member, each element having a cylindrical tube member with an interior and with an end opening which communicates with a respective mounting opening on the collar member for supplying natural gas to the interior of the tube member, each cylindrical tube member also having a tube slit along one side thereof and an outwardly extending flange portion; and wherein each of the tube slits has a fixed opening area through which natural gas can pass, the opening area being varied by varying the position of the flange portions of adjacent wing-shaped elements mounted within the collar member.

2. A burner array for supplying a combustible mixture of gases to the combustion region of a burner used to fire a water heating apparatus, the burner array comprising:

a collar member having a hollow interior which communicates with a source of combustible gas, the collar member having a peripheral interior surface with a plurality of mounting openings;

a ring-like arrangement of wing-shaped elements mounted on the peripheral interior surface of the collar member, each element having a cylindrical tube member with an interior and with an end opening which communicates with a respective mounting opening on the collar member for supplying combustible gas to the interior of the tube member, each cylindrical tube member also having a tube slit along one side thereof and an outwardly extending flange portion; and wherein each of the tube slits has a fixed opening area through which combustible gas can pass, the opening area being varied by varying the position of the flange portions of adjacent wing-shaped elements mounted within the collar member.

3. The burner array of claim 2, wherein each tube member is mounted on the peripheral interior surface of the collar by an adjustable fitting at a first angular position, the angular position of the outwardly extending flange portions of the wing-shaped elements being adjustable by turning the tube members in the adjustable fittings.

4. The burner array of claim 3, wherein the angular position of the outwardly extending flange portions of the wing-shaped elements can be adjusted between a closed position in which the outwardly extending flange portions form a generally closed plane within the collar member and obstruct the tube slit openings and an infinite number of angularly open positions which create flow paths across the position of the closed plane.

5. The burner array of claim 4, wherein the outwardly extending flange portion of each wing-shaped element extends approximately normal to a direction of flow of combustible gas exiting the tube slit opening.

6. The burner array of claim 5, further comprising control means located within the tube member interiors for controlling the flow of combustible gases into the interior of at least selected ones of the cylindrical tube members.

7. The burner array of claim 6, wherein the control means is a spring loaded poppet valve located within the interior of the at least selected ones of the cylindrical tube members.

8. An improved water heater or boiler, comprising:

a closed tank having an exterior, an interior and external walls having at least one end opening therein;

a submerged combustion chamber mounted within the tank end opening, the combustion chamber having multiple external heating surfaces which are submerged in water under pressure when the combustion chamber is mounted within the tank opening;

a flue collector mounted to the combustion chamber on the tank exterior, the flue collector having a flue opening communicating with the combustion chamber and having an annular chamber surrounding the flue opening and separated therefrom which receives the products of combustion produced within the combustion chamber, the annular chamber having a flue gas recirculation outlet;

a burner array mounted at the combustion chamber end opening for supplying a combustible mixture of gases to the combustion chamber for firing the water heating apparatus, the burner array comprising:

(a) a collar member having a hollow interior which communicates with a source of combustible gas, the collar member having a peripheral interior surface with a plurality of mounting openings;

(b) a ring-like arrangement of wing-shaped elements mounted on the peripheral interior surface of the collar member, each element having a cylindrical tube member with an interior and with an end opening which communicates with a respective mounting opening on the collar member for supplying combustible gas to the interior of the tube member, each cylindrical tube member also having a tube slit along one side thereof and an outwardly extending flange portion; and (c) wherein each of the tube slits has a fixed opening area through which combustible gas can pass, the opening area being varied by varying the position of the flange portions of the wing-shaped elements within the collar member.

9. The improved water heater or boiler of claim 8, further comprising:

an air-fed blower having an outlet which communicates with the combustion chamber for producing controlled combustion within the combustion chamber, the blower also having an air intake region.

10. The water heater or boiler of claim 9, further comprising:

a flue gas recirculation conduit passively connecting the flue gas recirculation outlet with the air intake region of the blower.

11. The water heater or boiler of claim 10, wherein the flue gas from the flue collector is divided between a primary flue gas recirculation conduit and a secondary, low fire flue gas recirculation conduit, both of which are connected with the air intake region of the blower.

12. A water heating apparatus, comprising:

a closed tank having an exterior, an interior and external walls having at least one opening therein;

a submerged combustion chamber mounted within the tank opening, the combustion chamber having an end opening;

a flue collector mounted on the tank, the flue collector having a flue opening communicating with the combustion chamber and having an annular chamber surrounding the flue opening and separated therefrom which receives the products of combustion produced within the combustion chamber;

a burner array mounted at the combustion chamber end opening for supplying a combustible mixture of gases to the combustion chamber for firing the water heating apparatus, the burner array comprising:

(a) a collar member having a hollow interior which communicates with a source of combustible gas, the collar member having a peripheral interior surface with a plurality of mounting openings;

(b) a ring-like arrangement of wing-shaped elements mounted on the peripheral interior surface of the collar member, each element having a cylindrical tube member with an interior and with an end opening which communicates with a respective mounting opening on the collar member for supplying combustible gas to the interior of the tube member, each cylindrical tube member also having a tube slit along one side thereof and an outwardly extending flange portion; and (c) wherein each of the tube slits has a fixed opening area through which combustible gas can pass, the opening area being varied by varying the position of the flange portions of the wing-shaped elements within the collar member.

13. The water heating apparatus of claim 12, wherein the submerged combustion chamber has an initially open end mounted adjacent the tank end opening, a closed end, and multiple external heating surfaces, and wherein the multiple external heating surfaces are curved fire tubes, each of the tubes having at least one end that extends through the closed end of the combustion chamber and an opposite end which communicates with the annular chamber of the flue collector.

14. The water heating apparatus of claim 13, further comprising ignition means located adjacent the burner array and including an ignitor for igniting the combustible gases, whereby products of combustion are produced in the combustion chamber and pass to the flue collector.

15. The water heating apparatus of claim 14, wherein the outwardly extending flange portion of each wing-shaped element extends approximately normal to a direction of flow of combustible gas exiting the tube slit opening.

16. The water heating apparatus of claim 15, wherein each tube member is mounted on the peripheral interior surface of the collar by an adjustable fitting at a first angular position, the angular position of the outwardly extending flange portions of the wing-shaped elements being adjustable by turning the tube members in the adjustable fittings.

17. The water heating apparatus of claim 16, wherein the angular position of the outwardly extending flange portions of the wing-shaped elements can be adjusted between a closed position in which the outwardly extending flange portions form a generally closed plane within the collar member and obstruct the tube slit openings and an infinite number of angularly open positions which create flow paths across the position of the closed plane.

18. The water heating apparatus of claim 17, further comprising control means for controlling the flow of combustible gases into the interior of at least selected ones of the cylindrical tube members.

19. The water heating apparatus of claim 18, wherein the control means is a spring loaded poppet valve located within the interior of the at least selected ones of the cylindrical tube members.

20. The water heating apparatus of claim 19, further comprising:

an air-fed blower having an outlet which communicates with the combustion chamber for producing controlled combustion within the combustion chamber, the blower also having an air intake region.

* * * * *